United States Patent [19]

Fröhlich et al.

[11] 4,058,145

[45] Nov. 15, 1977

[54] SLIDE FASTENER

[75] Inventors: Alfons Fröhlich, Essen; Julius Dahlmann, Sprockhovel; Günter Volter, Wuppertal, all of Germany

[73] Assignee: Opti Patent-, Forschungs- und Fabrikations AG, Glarus, Switzerland

[21] Appl. No.: 705,440

[22] Filed: July 15, 1976

[51] Int. Cl.[2] ..... A44B 19/42

[52] U.S. Cl. ..... 139/384 B; 24/205.16 C

[58] Field of Search ..... 139/384 B; 24/205.1 C, 24/205.13 C, 205.16 C

[56] References Cited

U.S. PATENT DOCUMENTS

| | | | |
|---|---|---|---|
| 2,963,047 | 12/1916 | Monahan | 139/384 |
| 3,789,465 | 2/1974 | Moertel | 24/205.1 |
| 3,847,188 | 11/1974 | Auer et al. | 139/384 |
| 3,892,262 | 7/1975 | Dahlmann | 139/384 |
| 3,974,550 | 8/1976 | Fujisaki | 24/205.16 |

*Primary Examiner*—Henry S. Jaudon
*Attorney, Agent, or Firm*—Karl F. Ross

[57] ABSTRACT

A slide-fastener stringer comprises, for each slide-fastener half, a support tape formed with a sewing strip and a facing strip, both having warp threads and a base weft thread extending all across both strips while a binding weft thread extends all across the sewing strip while engaging with reverse loops, the continuous coupling element which can be formed of a synthetic-resin monofilament. The monofilament may be of the helical-coil type in which each turn of the coil is formed with a coupling head adapted to fit between the coupling heads of an opposing coupling element, limbs or shanks connected to the head and connecting portions or bights connecting a limb of one head to a limb of the next head. The limbs against the support tape are provided with transverse grooves receiving an insertion thread which is woven into the tape.

4 Claims, 5 Drawing Figures

SLIDE FASTENER

FIELD OF THE INVENTION

The present invention relates to slide-fastener stringers and, more particularly, to woven-tape stringers having continuous coupling elements, e.g. helical coils.

BACKGROUND OF THE INVENTION

Such slide-fastener stringers comprise support tapes and rows of synthetic resin monofilament fastener links bearing thereon (more particularly continuous coupling elements of helical form) in which the links bear by means of limbs on the associated support tape.

Each link comprises a head interdigitating between the heads of an opposing coupling element, a pair of limbs or shanks connected to the head, and a connecting part or bight joining a limb of one link to a limb of a successive link.

Each support tape, which comprises a sewing strip and a mounting or facing strip, is built up from warp threads, a ground weft thread extending over the entire support tape width, and a binding weft thread for the associated row of fastener links.

The ground weft thread and the binding weft thread are passed together as loops over the width of the sewing strip and are joined at the free edge of the sewing strip to form a knitted edge. Reversal loops of the binding weft thread grip over the connecting parts of the row of fastener links either directly or via an interposed filler core.

On one side the facing strip covers the rows of fastener elements at least partially. The sewing strip of the support tapes is provided to sew the slide fastener in the garment or the like. A conventional slide is associated with the slide fastener to interdigitate and disconnect the coupling elements.

To produce such a slide fastener, each row of fastener links is supplied in the manner of a warp thread between the warp threads for the sewing strip and the warp threads for the facing strip to the shed formed by the warp threads and is woven onto the support tape by means of a binding weft thread which is guided through the shed as will be explained in detail below.

In the prior-art slide fastener of this type (see German Offenlegungsschrift No. 2,334,242, German Offenlegungschrift No. 2,304,011) a limb of each fastener link bears upon the support tape in the manner described. When subjected to transverse pull the binding weft thread and friction must transfer transverse tensile forces to the support tape to retain the rows of fastener links. This slide fastener has been found to require improvement with respect to the securing of the rows of fastener links on the support tapes against extreme transverse pulls of the kind which occur when the slide fastener is used for corsetry, shoes and the like.

OBJECT OF THE INVENTION

It is an object of the invention to improve upon the kind of slide fastener described above so that the rows of fastener links are reliably secured upon the support tapes even under conditions of extreme transverse pull.

SUMMARY OF THE INVENTION

These objects are attained in that the fastener link limbs which bear upon the support tapes each have a transverse groove (i.e. a groove extending transversely to the limb and thus substantially along the longitudinal axis of the slide fastener) in which an insertion thread is disposed. The insertion thread together with the rows of fastener links (coupling elements) are guided and woven-in as warp threads.

For slide-fastener constructions wherein a textile filler core or cord is disposed in each row of fastener links and bears upon the connecting parts, leaving free a coupling space to receive the coupling heads of the other coupling element, the transverse groove is formed approximately in the middle beneath the filler core, i.e. directly below the center of the width of this cord. The binding weft thread alternately grips above and below the said filler core.

Advantageously the support tape in the region of the facing strip is provided with means for absorbing extreme transverse tensile stresses. Preferably the support tape is constructed as a twill weave in the region of the facing strip and the binding weft thread is incorporated into the twill weave.

Special steps are also recommended for absorbing forces which are transferred by the binding weft thread into the associated support tape. To this end, the invention provides that two additional warp threads, which are substantially thicker than the other warp threads of the support tapes, are disposed in the transition zone between the facing strip and the sewing strip. The additional threads are surrounded in a twill weave by the binding weft threads and by the ground weft threads. Adjoining these thicker threads, the binding weft threads are passed over the connecting parts of the row of fastener links or over the filler core. The support tapes can also be stabilized by synthetic resin dressing.

The advantage of the improved slide-fastener stringer construction is that the fastener links are more firmly secured on the support tapes, even when subjected to extreme transverse pull. This is achieved by the quasi-positive engagement between components of the support tape, even though these are textile, and the associated row of fastener links, because of the presence of the transverse groove and the insertion thread which fills the said transverse groove as completely as possible, the insertion thread in the construction described above being fully integrated in the support tape in terms of weaving technology.

SPECIFIC DESCRIPTION

Figure 1:
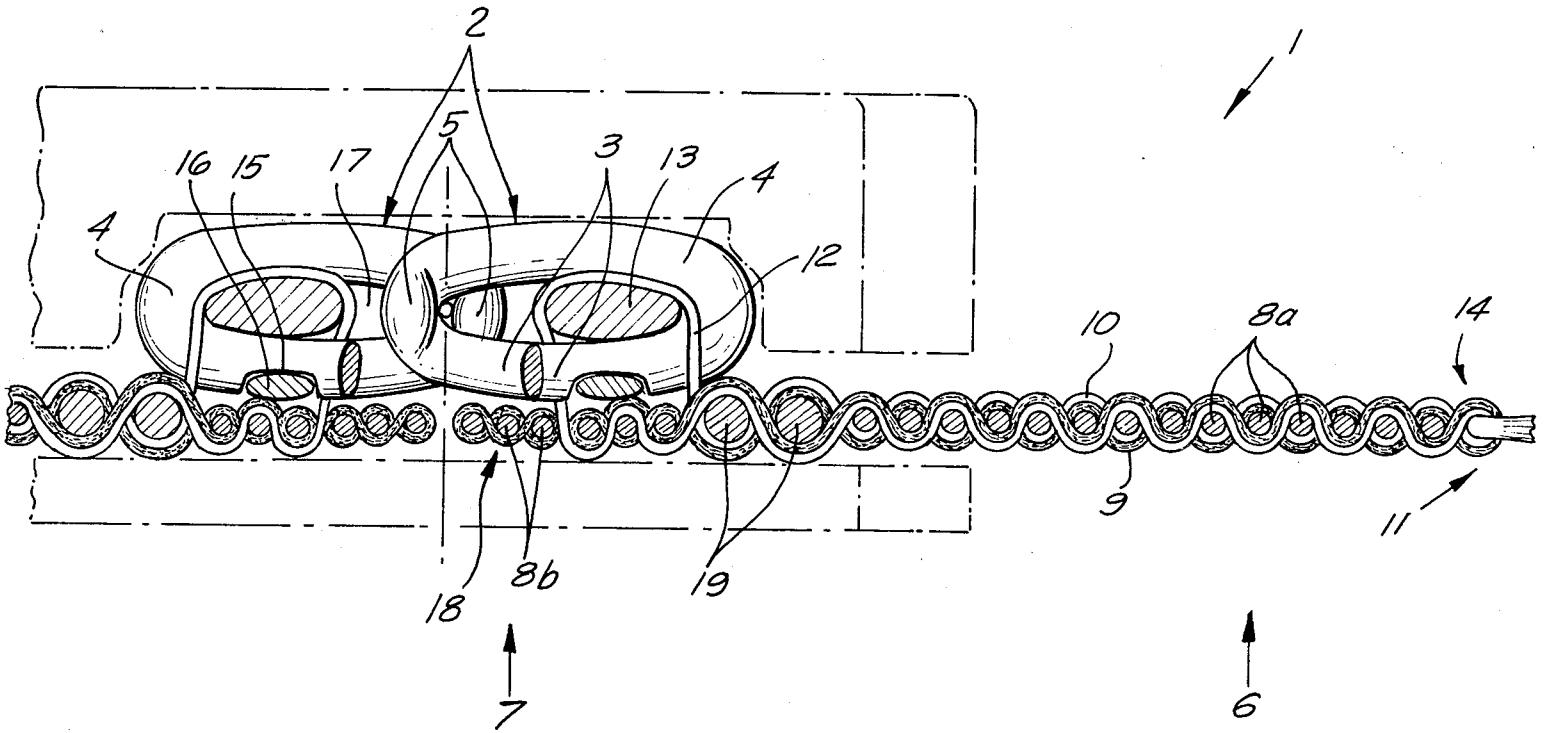
FIG. 1 is a cross-section through a slide fastener according to the invention to a scale which is greatly enlarged over actual size.
Figure 2:
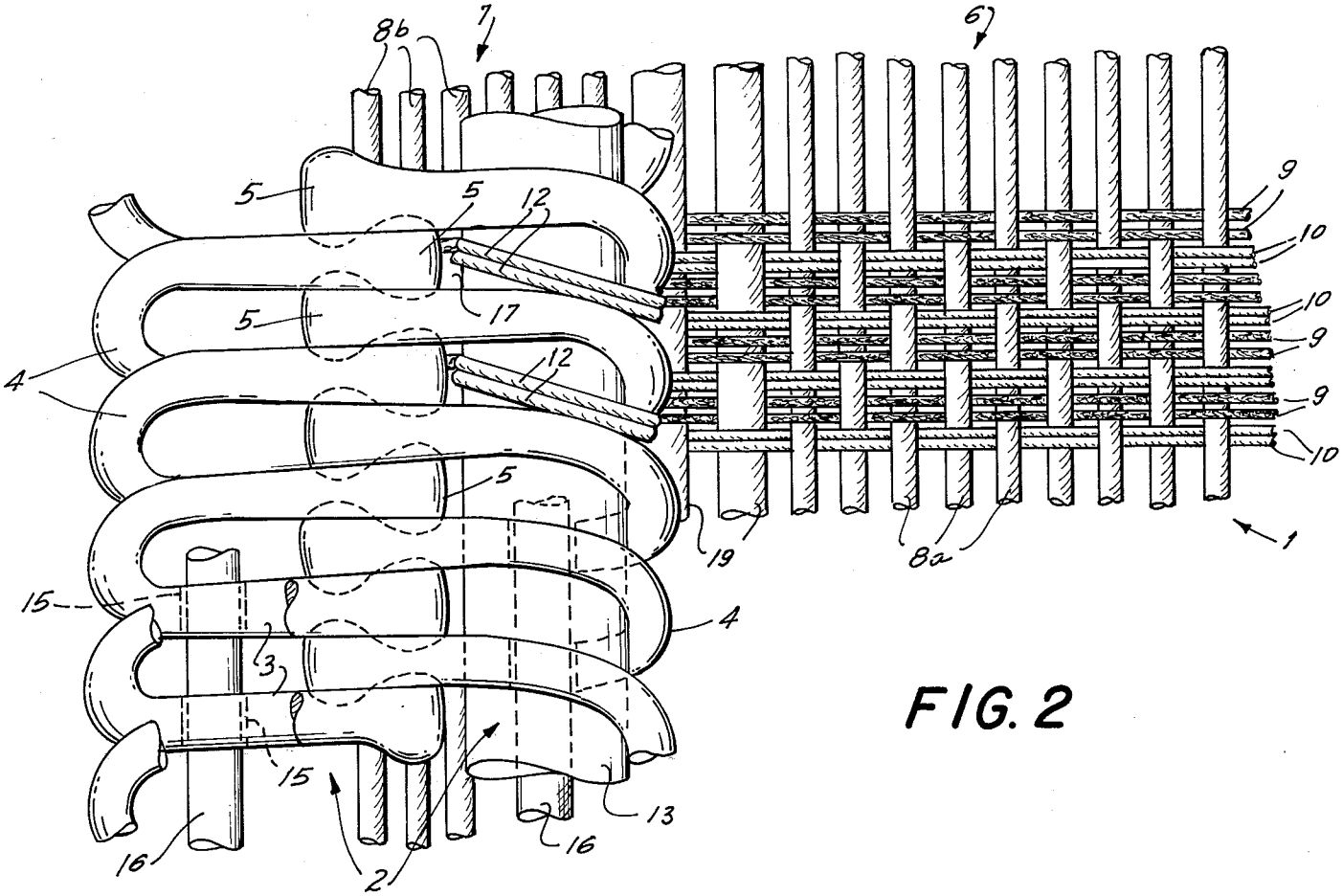
FIG. 2 is a plan view of a portion of the stringer of FIG. 1.

The slide fastener illustrated in FIGS. 1 and 2 substantially comprises the support tapes 1 and the plastics monofilament rows of fastener elements 2 which bear thereon. In the exemplified embodiment, these are helical rows of fastener elements 2. The fastener elements bear by means of limbs 3 on the associated support tape 1. They are joined by connecting parts 4 and support the coupling heads.

Each support tape 1 comprises a sewing strip 6 and facing strip 7 and is built up from warp threads 8 as well as from a ground or base weft thread 9 which extends over the entire support tape width and a binding weft thread 10 for the associated row of fastener links.

Figure 5:
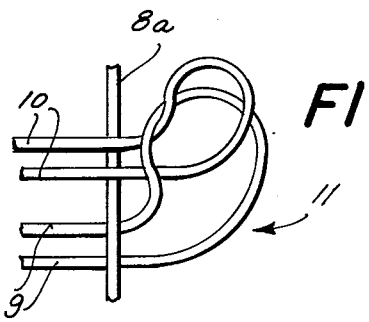
FIG. 5 is a diagram of the knitting together of the weft threads at an edge of the tape.

A comparison of FIGS. 1 and 2 discloses that the ground weft thread 9 and the binding weft thread 10 are passed together as loops over the width of the sewing strip 6 and are joined at the free edge 11 of the sewing strip 6 to form an edge 14. In other respects, the arrangement is such that the binding weft thread 10 and its reversal loops 12 directly grips over the connecting parts 4 of the row of fastener elements or in the exemplified embodiment via the interposition of filler core 13 which is inserted into the rows of fastener elements 2. The loops formed together by the ground weft thread 9 and the binding weft thread 10 can be combined into a knitted edge 11 with or without the use of an additional snagging thread which is not shown (see FIG. 5 for example).

FIG. 1 more particularly discloses that the fastener link limbs 3 which bear upon the support tapes 1 have a transverse groove 15 in which an insertion thread 16 is disposed and that the insertion thread 16 together with the row of fastener links 2 is guided and woven-in as warp thread. The expression transverse groove was chosen because the groove 15 extends transversely to the limbs of the fastener links. However, expressed in other terms, it extends along the longitudinal direction of the slide fastener.

Textile filler cores 13 are disposed in the rows of fastener links 2, the filler cores bearing upon the connecting parts 4. At the coupling heads 5 of the fastener links there remains a free coupling space 17 in front of the filler cores 13 when the slide fastener is in the uncoupled state to accommodate the heads of the opposed coupling element.

The transverse groove 15 is situated approximately in the middle beneath the filler core 13. The binding weft threads 10 alternately grip above and below the filler core 13. The section of FIG. 1 shows the threads gripping above the core. However, the binding weft thread 10 extends in the reverse direction in the next shed, thus securing the filler core 13. In the region of the facing strip 7 and where the rows of fastener links 2 bear the facing strips are constructed in twill weave 18, the binding weft thread 10 being incorporated into the twill weave 18.

FIGS. 1 and 2 also show the additional warp threads 19, which are substantially thicker than the remaining warp threads of the suport tapes 1, disposed in the transition zone between the facing strips 7 and the sewing strip 8. The additional warp threads 19 are surrounded in twill weave by the binding weft threads 10 and by the ground weft threads 9. Adjoining thereon the binding weft thread 10 is passed over the connecting parts 4 of the rows of fastener links 2 or is passed over the filler core 13. The support tapes 1 can be stabilized by a synthetic resin dressing (not shown).

Figure 3:
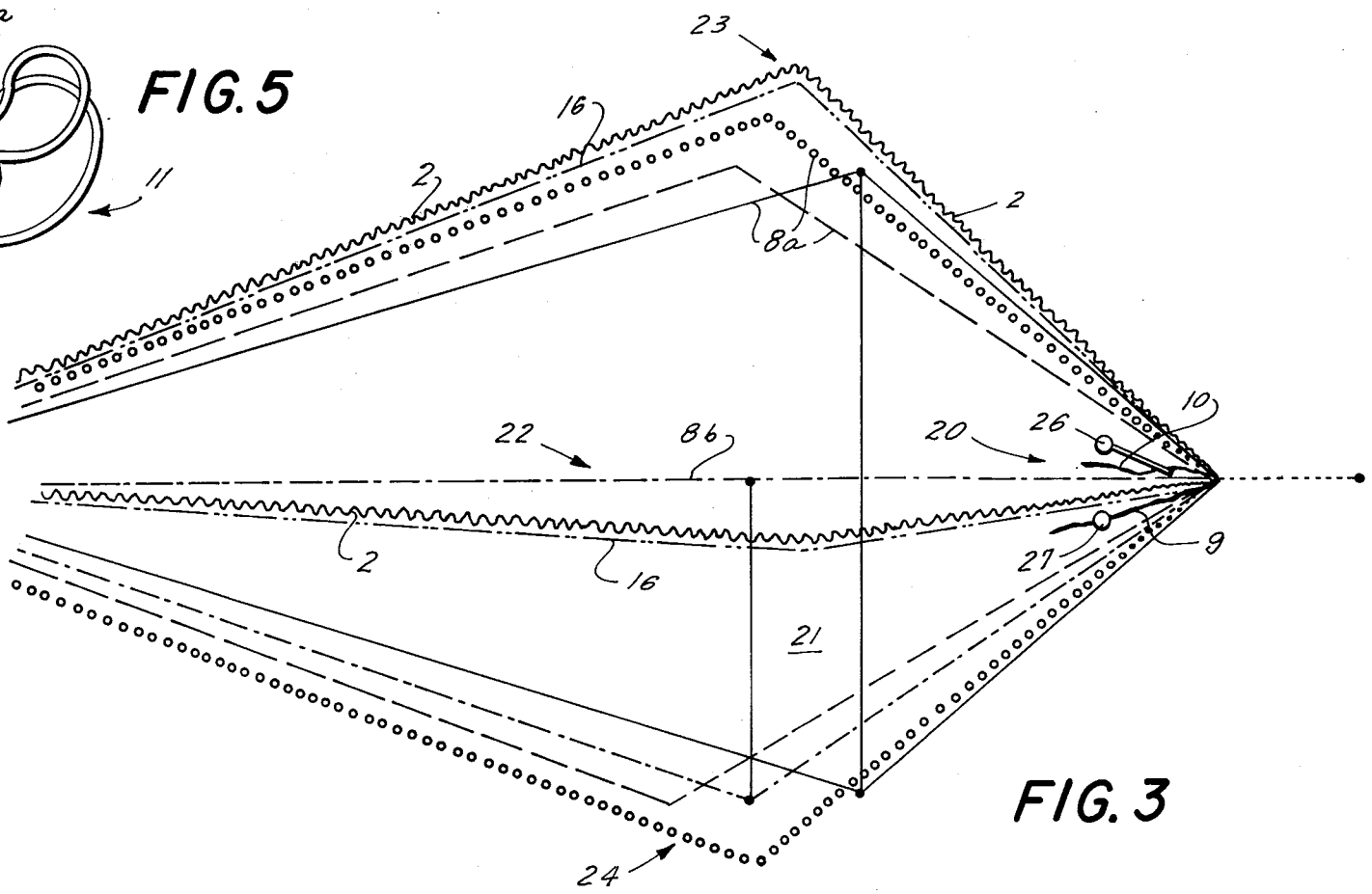
FIG. 3 is a shed diagram which clarifies the process according to the invention.
Figure 4:
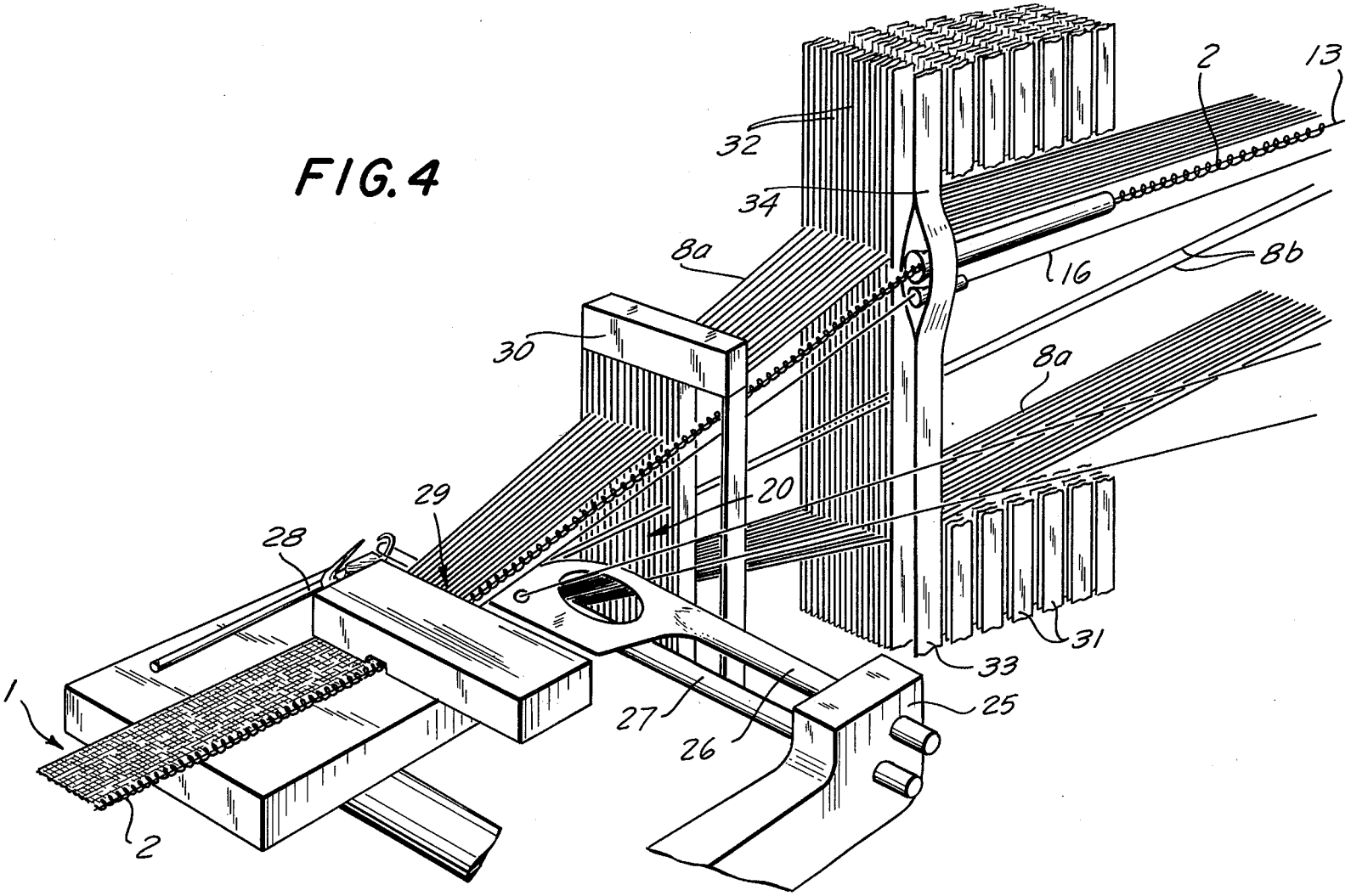
FIG. 4 is a section of a loom equipped to perform the process according to the invention.

FIGS. 3 and 4 illustrate the method of the invention. FIG. 3 shows that each row of fastener links 2 is supplied in the manner of a warp thread between the warp threads **8*a* for the sewing strip 6 and the warp threads 8*b* for the facing strip 7 to the shed 20 which is formed by the warp threads 8 and is woven on to the support tape 1 by means of a binding weft thread 10 which is passed through the shed 20**.

To this end, the system is arranged so that to form a bottom shed 21 some of the warp threads **8*b* for the facing strip 7 are moved in a continuously alternating pattern into a middle position 22 and the remainder are moved into a bottom shed position 24 and to form a main shed on both sides of a neutral middle position 22 some of the warp threads 8*a* for the sewing strip 6 are moved in a continuously alternating pattern into a top shed position 23 and the remainder are moved into a bottom shed position 24 while the coupling element 2 is alternately moved into a top shed position 23 and into a middle position 22**.

It can also be seen that the ground weft thread 9 beneath the middle position 22 of each row of fastener links 2 is picked from the free edge of the facing strip 7 into the bottom shed 21 and into the main shed 20 and the binding weft thread 10 between the middle position 22 and the top shed position 23 of the row of fasteners 2 is simultaneously picked inot the main shed 20 in the form of a loop in each case.

The loops which are formed in combination by the ground weft thread 9 and by the binding weft thread 10 are joined into a knitted edge 11 (FIG. 5) at the free edge of the sewing strip 6 and one of the connecting parts 4 of the row of fastener elements 2 and the filler core at that place are gripped by the reversal loop 12 of the binding weft thread 10 with each picking motion of the ground weft thread 9 and of the binding weft thread 10. According to the invention, the insertion thread 16 is guided and woven-in parallel to and together with the row of fastener links 2.

FIG. 4 diagrammatically shows machine parts which are required in a loom equipped for performing the method according to the invention. The top weft needle 26 and the bottom weft needle 27 are disclosed on the weft needle holder 25. The crochet needle 28 for forming the knitted edge 11 is situated on the other side. The weaving point is indicated by the arrow 29. The reed 30 can be seen approximately in the middle of the illustration. On the right-hand side of the reed 30 are shown the shafts 31, 33 and the heddles 32, 34, the special shaft 33 and the special heddle 34 for guiding the coupling element 2 with the filler core 13 or for guiding the insertion thread 16 can be recognized. It can be seen that these two components of a slide fastener according to the invention are guided in parallel.

What is claimed is:

1. A slide-fastener stringer having a pair of stringer halves, each of said stringer halves including a respective support tape and a continuous coupling element mounted on said support tape, said support tape comprising a sewing strip and a facing strip adjacent said sewing strip, both of said strips being formed with warp threads, said support tape having a ground weft thread extending the full width of said tape and interwoven with said warp threads, and a binding weft thread extending the width of said sewing strip and securing said coupling element to said support tape with reverse loops, said coupling element having a succession of coupling heads adapted to interdigitate with an opposing similar coupling element, and limbs connected to said heads and resting against said support tape, said limbs being formed with transverse grooves aligned generally longitudinally of the coupling element, and an insertion thread received in said grooves and woven as a warp thread into said support tape, said coupling element being a helical turn coupling element, said stringer comprising a textile filler cord received in said coupling element and spaced away from the heads thereof, said grooves being disposed substantially centrally beneath said filler cord.

2. The stringer defined in claim 1 wherein said support tape is constituted of a twill weave in the region of said facing strip and said binding weft thread is incorporated in said twill weave.

3. A slide-fastener stringer having a pair of stringer halves, each of said stringer halves including a respective support tape and a continuous coupling element mounted on said support tape, said support tape comprising a sewing strip and a facing strip adjacent said sewing strip, both of said strips being formed with warp threads, said support tape having a ground weft thread extending the full width of said tape and interwoven with said warp threads, and a binding weft thread extending the width of said sewing strip and securing said coupling element to said support tape with reverse loops, said coupling element having a succession of coupling heads adapted to interdigitate with an opposing similar coupling element, and limbs connected to said heads and resting against said support tape, said limbs being formed with transverse grooves aligned generally longitudinally of the coupling element, and an insertion thread received in said grooves and woven as a warp thread into said support tape, said tapes further comprising a pair of additional warp threads of a greater thickness than the remaining warp threads disposed in said warp at the junction between said strips and passed around by said weft threads in a twill weave, said reverse loops of said binding thread securing said coupling element to said support tape directly adjacent said additional warp threads.

4. The stringer defined in claim 3 wherein said coupling element is a helical turn coupling element, said stringer comprising a textile filler cord received in said coupling element and spaced away from the heads thereof, said grooves being disposed substantially centrally beneath said filler cord.

* * * * *